United States Patent [19]

Anderson

[11] Patent Number: 4,620,317

[45] Date of Patent: Oct. 28, 1986

[54] TABLETOP SPEAKER ASSEMBLY

[75] Inventor: Carl R. Anderson, Wilmette, Ill.

[73] Assignee: Shure Brothers, Inc., Evanston, Ill.

[21] Appl. No.: 597,249

[22] Filed: Apr. 5, 1984

[51] Int. Cl.[4] ..... H04R 1/28; H04R 1/02; H04R 1/32

[52] U.S. Cl. ..... 381/90; 179/146 E; 179/179; 181/155

[58] Field of Search ..... 381/90, 87, 88, 91, 381/93; 179/18 BC, 146 E, 179; 181/144, 155

[56] References Cited

U.S. PATENT DOCUMENTS

| | | | |
|---|---|---|---|
| 2,230,104 | 1/1941 | Bostwick | 381/91 |
| 3,326,321 | 6/1967 | Valuch | 181/144 |
| 4,078,155 | 3/1978 | Botros et al. | 179/18 BC |
| 4,200,170 | 4/1980 | Williams, Jr. | 181/144 |
| 4,348,549 | 9/1982 | Berlant | 181/155 |

FOREIGN PATENT DOCUMENTS

| | | | |
|---|---|---|---|
| 2433916 | 1/1979 | Fed. Rep. of Germany | 181/155 |
| 2837182 | 3/1979 | Fed. Rep. of Germany | 181/144 |
| 2417229 | 9/1979 | France | 381/88 |
| 653263 | 5/1951 | United Kingdom | 181/155 |

*Primary Examiner*—Gene Z. Rubinson
*Assistant Examiner*—Danita R. Byrd
*Attorney, Agent, or Firm*—Allegretti, Newitt, Witcoff & McAndrews, Ltd.

[57] ABSTRACT

A speaker assembly is disclosed for use on a desk or tabletop, in conjunction with a telecommunication or teleconferencing system. The assembly includes a speaker supported above a generally conical and circular base having one or more acoustically reflective surfaces angled away from the speaker. A cover or cabinet is mounted around the rear of the speaker, and the speaker is attached to the assembly by a support plate mounted within the cover. The height of the interior of the cover is approximately the same as the height of the speaker. A plurality of bushings connect the support plate to the base. Sound exits from the assembly at substantially the level of the surface upon which the assembly rests. In the prefered embodiment, the conical base has a truncated upper portion, preferably formed as an inverted conical cavity coencentric with the circular base.

2 Claims, 3 Drawing Figures

TABLETOP SPEAKER ASSEMBLY

BACKGROUND AND SUMMARY OF THE INVENTION

This invention relates to a speaker assembly, and more particularly it relates to an improved assembly for a tabletop or desk mounted speaker that may be used to reproduce telecommunication sound from teleconferencing systems and the like.

Conventional speakers and other sound generating devices used in speaker systems or assemblies normally produce a sound directed principally in a single direction. Typically, economical speakers have a sound drive mechanism or "cone," wherein sound is generated through the open concave or front portion (the "drive" side) of the cone and is restricted in its transmission from the rear of the cone. Sound quality and response is therefore optimum when a listener is positioned at the concave open side of the speaker. Telephone conferencing systems often employ a single speaker to provide sound to all conference participants in a single room. In some circumstances, such as a teleconference occuring with several participants in a board room, the speaker is preferably centered on a table, desk or other horizontal surface between the participants. Such tabletop speakers ideally should be adapted to produce uniform quality response radially about the speaker's position, so that each participant to the conversation who is seated about the table or desk will hear equal high sound quality.

Accordingly, when conventional speakers are used on tabletops, they may be positioned with the drive side of the speaker oriented vertically and directed to drive sound either upward from the table or downward to that surface. Upward direction of a sound in a vertically oriented economical speaker can result in principal direction of the sound toward the room's ceiling. Because teleconferencing listeners typically sit at approximately the same height, or a slightly higher height, than that of the speaker assembly, upward direction of the sound can require operation of the speaker at an unnecessarily loud volume to provide adequate dispersion of room filling sound at the listener level. Optimally, the sound generated by a tabletop speaker should have its best response occur radially about the speaker at positions approximately thirty degrees above the table.

To efficiently operate the speaker, and to eliminate the need for excess volume, conventional cone speakers may be vertically oriented with the drive side of the speaker directed downward. In this arrangement, sound reflects from the table, desk, or other surface with equal volume and response radially in all directions from the speaker to the listeners. However, while such an orientation eliminates volume adjustment problems, other problems such as destructive and additive interference of the sound waves can result; such interference results because the sound travels to the listeners not only in a direct path from the speaker, but in a reflected path from the horizontal surface toward which the sound is principally directed.

Accordingly, an object of this invention is to provide a speaker assembly for use in a telecommunication or teleconferencing system.

Another object of this invention is to provide a speaker assembly that can produce sound that is uniform in volume and response radially about the assembly when the assembly is placed on a flat horizontal surface, such as a table or a desk.

A further object of this invention is to provide a speaker assembly for a teleconferencing system that does not require excessive volume for adequate sound dispersion to listeners who are positioned around the assembly and slightly higher than the assembly's location.

Another object of this invention is to provide a speaker assembly for use on a horizontal surface such as a table or desk that does not produce destructive or additive interference in the sound waves between the sound following the direct and reflected paths from the speaker to the listener.

These and other objects of the invention are accomplished by providing a speaker assembly for use on a desk, table, or other flat surface capable of directing sounds in all directions from a speaker. The assembly comprises a speaker supported above a generally conical circular base having an acoustically reflective surface angled away from the speaker. Sound exits from the assembly at substantially the level of the table or other surface upon which the assembly rests. A cover or cabinet is mounted above and surrounding the rear of the speaker, and the speaker is attached to the assembly by a support plate attached to the cover. The height of the interior of the cover is approximately the same as the height of the speaker. A plurality of bushings connect the support plate to the base. In the preferred embodiment, the conical base has a truncated upper portion, preferably formed as an inverted conical concavity concentric with the base.

DETAILED DESCRIPTION OF THE PREFERRED EMBODIMENT

Figure 1:
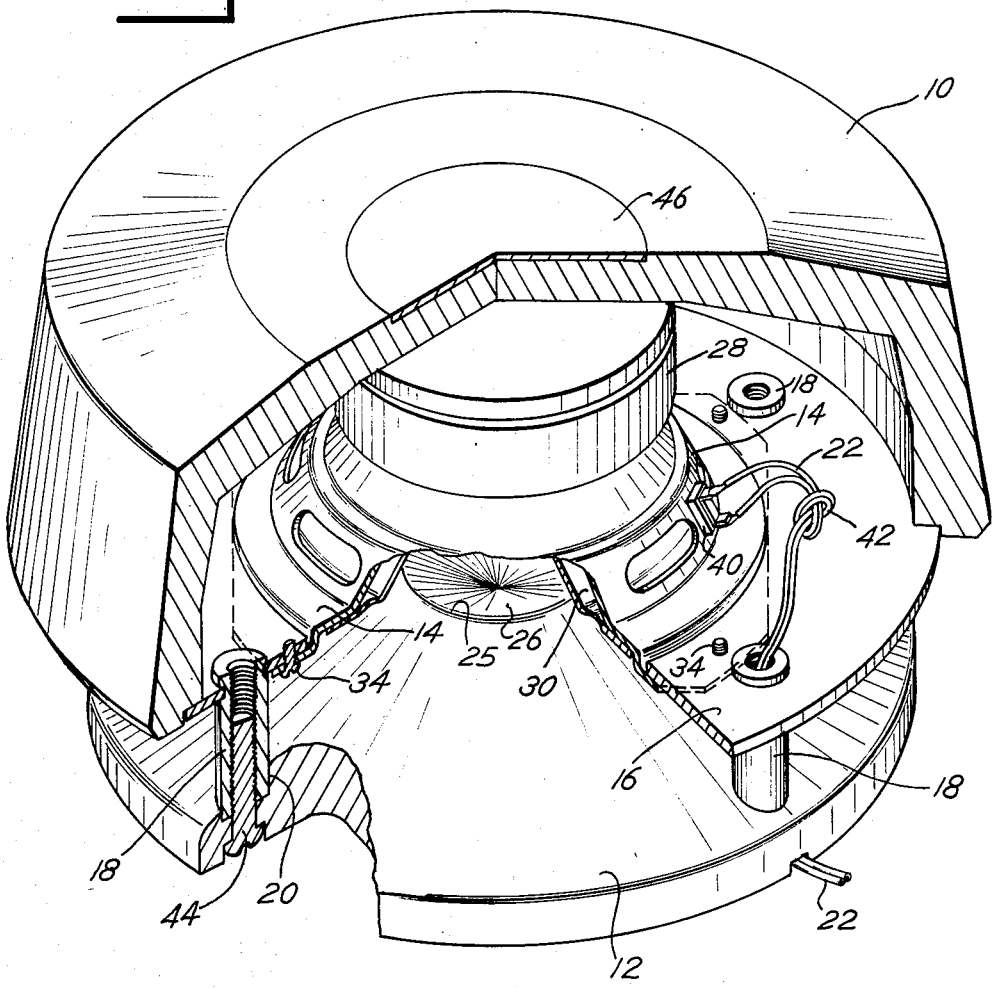
FIG. 1 is a pictorial cut-away view showing the speaker assembly, with the speaker positioned within the cover to principally direct sound toward the conical base.
Figure 2:
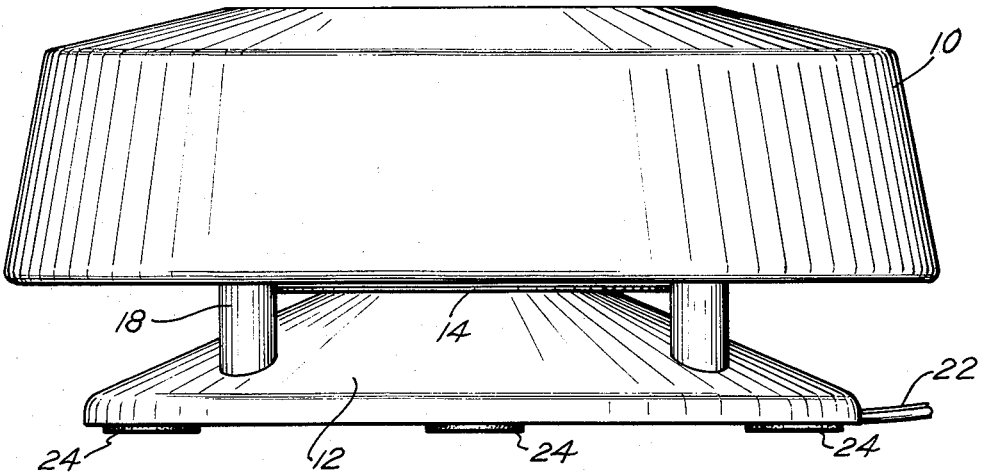
FIG. 2 is a side view of the speaker assembly showing the cover, base, and supports for the base.

Referring now to FIGS. 1 and 2, the preferred embodiment of the invention is a speaker assembly for use in teleconferencing systems, and specifically for use on a desk, table or other flat surface that may be surrounded by listeners. The invention generally comprises of a cover 10, a base or acoustic reflector 12, and a speaker 14. The speaker is attached to a support plate 16, which in turn is mounted within the cover 10. A plurality of bushings 18 position the support plate a measured distance above the base 12. The speaker 14 is positioned upon the support plate 16 to direct sound downwardly toward and in the vicinity of the generally circular base 12.

The sides of the base facing the speaker are angled away from the speaker to near the surface upon which the assembly rests, and are composed of an acoustically reflective material such that sound is radially reflected in all horizontal directions off of the base 12. The cover 10 preferably extends below the top of the base 12 so that sound exits from the assembly at or near the level of the table, desk or other surface, thereby helping to minimize interference effects. To support the speaker 14 and support plate 16, the base 12 has a plurality of openings 20 for receiving the bushings 18. In the preferred embodiment, at least one bushing 18 is hollow, allowing a cable 22 to pass into the speaker assembly and provide a current to drive the speaker 14. In the preferred embodiment, the base 12 is mounted on soft pads 24 to minimize marring or scratching of the table or other surface upon which the speaker assembly may be placed.

Figure 3:
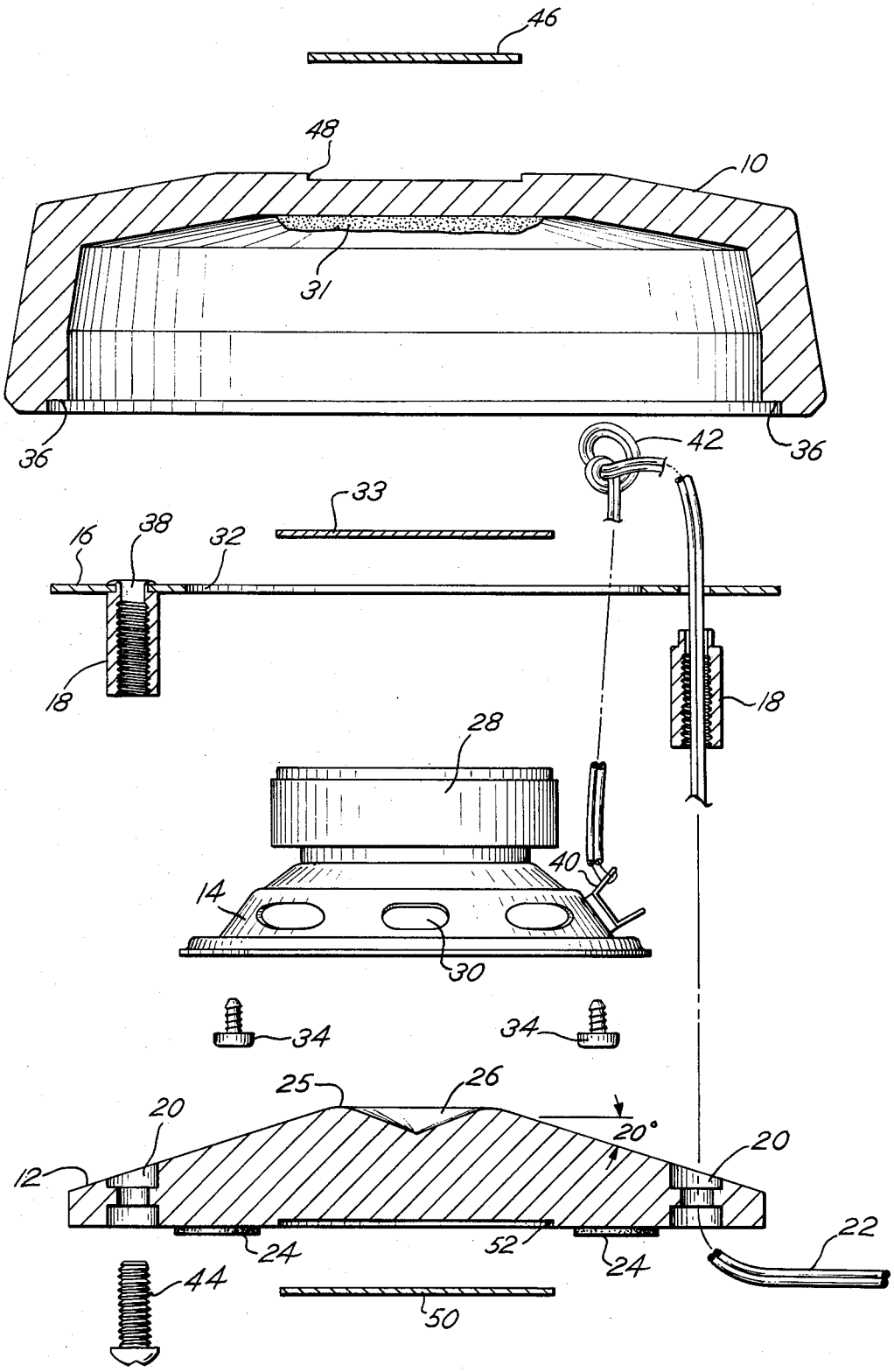
FIG. 3 is an exploded cross-sectional side view of the speaker assembly illustrating details of the assembly and the internal configuration of the invention.

Referring now to FIG. 3, additional details of the preferred embodiment are illustrated. In the preferred embodiment, the base 12 is generally conical and of generally triangular cross-section, with the upper portion 25 of the cone truncated and recessed to form a cavity 26 at the portion of the base 12 nearest the speaker 14. In the preferred embodiment, the angle between the horizontal and the sides of the generally conical base plate 12 is approximately twenty degrees, allowing sound to be directed from the speaker principally to a position removed approximately thirty degrees above the table or horizontal surface on which the speaker assembly is mounted; the thirty degree position corresponds generally to the position of seated listeners arranged around a table.

As shown in FIG. 3 the truncated portion of the base is a generally conical cavity or recess 26 positioned in the top portion of the conical base 12. In the preferred embodiment, the depth of the recess 26 is approximately one-third the full heighth of the conical portion of the base 12. FIG. 3 further illustrates the general orientation of the speaker 14, with the drive magnet 28 positioned away from the base 12 and the cone 30 positioned to direct sounds toward the base 12. Although the preferred embodiment incorporates a conventionally driven magnetic speaker, any speaker or sound generating mechanism capable of directing sound downwardly towards the base 12 is appropriate for use with this invention.

In the preferred embodiment, resonant vibration of the cover 10 is prevented by use of a dampening putty 31 inserted between the drive magnet 28 and the cover 10. Any tendency of the cover to resonate or "ring" during operation of the assembly is absorbed by the combined dampening effect of the putty 31 and fixed-position drive magnet 28. In the preferred embodiment, the putty 31 is composed of a silicone-rubber gel. To prevent adherance of the drive magnet to the putty, and to thereby allow easy disassembly of the speaker 14 from the cover 10, the drive magnet 28 is separated from the putty 31 by a gasket 33, which in the preferred embodiment is composed of a waxed paper segment.

Mounting of the speaker 14 within the cover 10 is accomplished by positioning the speaker 14 in a generally circular hole 32 within the support plate 16 corresponding to the circular cross-section of the cone 30. The speaker is attached to the support plate 16 by means of fasteners, which in the preferred embodiment comprise screws 34. The support plate 16 is fastened to the bottom of cover 10 by placing it within notch 36. In the preferred embodiment, the support plate 16 is fastened within the notch by a permanent adhesive; in alternative embodiments, the support plate may be fastened within notch 36 by screws, bolts, or by any other common means of attachment.

Provision of a drive current to speaker 14 is accomplished through use of a cable 22 inserted through passage 38 in one of the bushings 18. Cable 22 leads from a signal source such as a telecommunication system to electrical connector 40 on the speaker 14. In the preferred embodiment, disconnection of cable 22 from electrical connector 40 is prevented by providing a knot 42 in cable 22 of a size larger than passage 38 in bushings 18. Finally, base 12 is secured to support plate 16 by inserting the bushings 18 into the openings 20, and securing a plurality of bolts 44 through openings 20 into bushings 18. The speaker assembly is therefore secured in a generally inflexible arrangement.

The preferred embodiment also includes a top label 46 that may be secured flush with the top of the cover within an upper notch 48. Similarly, the preferred embodiment includes a bottom label 50, that may be secured flush with the bottom of the base within the lower notch 52.

In operation, the base 12 acts first as a base or support for the speaker assembly; second as an acoustic reflector directing sound radially about the speaker assembly to positions approximately thirty degrees above the height of the surface upon which the assembly rests or is mounted; and third as a phase plug to control and minimize the volume of air between the speaker cone 30 and the base 12.

Optimally, the volume of air between the speaker cone and the base 12 should be such as to produce peak frequency response from the assembly in the range of frequencies transmitted by telephone systems. Thus, optimum frequency response should occur in the range of 300 hertz to 3 kilohertz. As is well known in the art, as the volume of air between speaker cone 30 and the base 12 increases, the system's response to sound frequencies generated in the high range (3–5 kilohertz) decreases. Conversely, response of high frequency sounds increases as the volume of air decreases. Hence, for best generation of high frequency sound, the separation between the base 12 and the speaker cone 30 should be reduced to the minimum possible. Since conventional magnetic speakers have a central dome (not shown in the illustrations) within the speaker cone extending in the direction of the principal sound generation, the concave recess 26 in the top of the base 12 allows positioning of the speaker closer to the base. Because at very low frequencies the displacement of the cone and dome can reach nearly 1/32 of an inch, the optimal separation for the preferred embodiment of the assembly should be approximately 1/32 of an inch. However, conventional magnetic speaker cones are manufactured with adhesive connections on the cone where the electrical lead touches the speaker cone 30, creating bumps or knobs extending, in some instances, more than 1/16 of an inch from the cone 30. Because actual contact of the speaker cone 30 with the base 12 would drastically degrade sound quality, the separation of speaker cone 30 from base 12 in the preferred embodiment is approximately ⅛ inch.

As is also well known in the art, speakers such as speaker 14 have a resonance frequency, below which sound generation decrease rapidly; the resonance frequency generally determines the lowest frequency reproduced. As is further well known in the art, enclosure of the rear of the speaker in a cover or cabinet adds the pneumatic stiffness of the air cavity to the mechanical stiffness of the cone suspension, and thereby raises the speaker resonance frequency within the enclosure. Accordingly, low frequency output can be controlled by varying the volume of air within the cover 10 to the rear of the speaker 14. In the preferred embodiment, the height of the interior of the cover is approximately the same as the height of the speaker.

For conventional speakers such as speaker 14, optimum visual aesthetics are achieved with the drive magnet 28 as close to the inside of the cover 10 as possible (without directly contacting the cover), so that the assembly creates a minimum visual obstruction above the table. Variation of the diameter of the cover 10 then produces a peak in the frequency response where the wave length of the sound is approximately the same as the diameter of the cover 10. In the preferred embodiment, the diameter has been chosen to be approximately six inches, which produces a peak in frequency response at a frequency within the normal range of sounds transmitted by telephone communications, that peak being at approximately 2 kilohertz.

Although the preferred embodiment of the invention includes a conical recess in the top of the base 12, a variety of other configurations for the base 12 are possible. Alternative embodiments of the top of the base 12 include a semispherical recess, a flat top, a pointed convex conical top, and a pointed convex conical top with a more acute angle to the upper cone surface than the general conical angle of the base 12. Moreover, the configuration of the base 12 is not limited to strict conical sides, but instead may use any configuration that allows sound to be radially reflected in generally all horizontal directions away from the speaker assembly. Additionally, the assembly may be constructed to direct sound from the speaker in just a few of the circumferential directions.

Finally, the terms used in the claims and specification should not be construed in their most limited sense. For instance, the term "speaker" should be construed to include any device capable of generating sound from electrical signals, and the term "cover" should include any arrangement that produces an acoustically sealed environment to the rear of the speaker. The term "horizontal" should be construed to refer to all directions parallel to the surface upon which the assembly rests or is mounted; if the assembly were mounted on a vertical wall, the term would then refer to all vertical directions. Similar variations are allowable in the other terms used in the specification and claims. Moreover, where specific sizes, dimensions or frequencies are mentioned, the invention should not be construed to be thereby limited, unless those sizes, dimensions or frequencies are expressly included in the claims.

What is claimed is:

1. A tabletop speaker assembly for a teleconferencing system or the like, the speaker assembly being of the kind adapted to rest on a generally flat surface, comprising, in combination:

a base for supporting the assembly, the base having a generally conical configuration with a peak and a bottom, and having one or more acoustically reflective surfaces angled from the peak to the bottom of the base to form an approximate 20 degree angle relative to the generally flat surface on which the assembly rests;

a support plate affixed to the base;

a speaker having a speaker cone and a rear portion opposite the speaker cone, with the speaker supported by the plate above the base with the speaker further positioned to direct sound downward toward the base's acoustically reflective surfaces;

a cover having an interior height also supported by the plate and surrounding the speaker's rear, the assembly being configured with the rear of the speaker positioned very close to the inside of the cover, the height of the interior of the cover being approximately the same as the height of the speaker, the speaker cone being positioned approximately ⅛ inch or less from the base's peak, and the cover extending near the base such that the sound exits from the assembly near the base, and further configured with the portion of the base closest to the speaker cone being concave away from the speaker, the concave portion of the base being configured as an inverted cone concentric with the conical base and extending into the base a distance approximately equal to one-third of the height of the base; and a plurality of bushings received in openings in the base, the plate being supported by the bushings, and with at least one bushing being hollow to allow a cable to pass into the assembly.

2. A tabletop speaker assembly for a teleconferencing system or the like as claimed in claim 1 wherein a layer of dampening putty is inserted between the rear of the speaker and the cover to minimize reasonance during operation of the assembly, the layer being thin relative to the height of the speaker and separated from the rear of the speaker by a gasket.

* * * * *